US006714753B2

(12) United States Patent
Garcia et al.

(10) Patent No.: US 6,714,753 B2
(45) Date of Patent: Mar. 30, 2004

(54) TONING STATION INTERMEDIATE BEARING CAP AND TENSION ASSEMBLY

(75) Inventors: Christopher S. Garcia, Rochester, NY (US); Kenneth M. Patterson, Hilton, NY (US); Paul E. Thompson, Webster, NY (US); Charles R. Winterberger, Honeoye Falls, NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/760,974

(22) Filed: Jan. 16, 2001

(65) Prior Publication Data

US 2002/0094215 A1 Jul. 18, 2002

(51) Int. Cl.[7] ..... G03G 15/08
(52) U.S. Cl. ..... 399/252
(58) Field of Search ..... 399/252, 162, 399/165, 167, 411, 126, 222, 226, 228; 474/101, 111, 112

(56) References Cited

U.S. PATENT DOCUMENTS 3,794,417 A * 2/1974 Machmer ..... 399/322
4,205,622 A * 6/1980 Miyake et al. ..... 399/240
4,274,362 A * 6/1981 Beck et al. ..... 399/256
4,840,259 A * 6/1989 Guslits et al. ..... 192/48.2
4,915,280 A * 4/1990 Howes et al. ..... 226/74
5,007,351 A * 4/1991 Muth ..... 105/101
5,103,764 A * 4/1992 Fujiwara et al. ..... 399/226
5,246,404 A * 9/1993 Ojima ..... 474/111
6,275,672 B1 * 8/2001 Blum et al. ..... 399/126
6,398,681 B1 * 6/2002 Wanie ..... 474/101

* cited by examiner

*Primary Examiner*—Hoan Tran

(57) ABSTRACT

An improved electrophotographic toning station for use in an electrophotographic printer includes a unitary bearing cap and tension sprocket assembly that allows for the use an intermediate drive chain to drive a primary drive sprocket that drives the toning shell at high speed, through a primary drive chain. A unitary bearing cap and tension sprocket assembly that allows the tension sprocket assembly to be properly located relative to the intermediate and primary drive sprockets, such that the components of the toning station may be adjusted relative to each other without interference from the tension sprocket assembly.

21 Claims, 5 Drawing Sheets

TONING STATION INTERMEDIATE BEARING CAP AND TENSION ASSEMBLY

BACKGROUND OF THE INVENTION

1. Field of the Invention

This invention relates to a toning station employed in electrophotographic printers and copiers. More particularly, this invention relates to a bearing cap and tension assembly used to increase the toning shell speed, and to toning stations and electrophotographic printers including such a bearing cap and tension assembly.

2. Brief Description of the Related Art

Throughout this disclosure, the term "electrophotographic printer" is to be construed to include both printers and copiers employing electrophotographic means for image production. Electrophotographic printers that utilize a dry ink toner-based developer include a developer station having a rotating toning shell that is used to transport the developer mix to the site where the toner is applied to a photoconductor that carries an electrostatic image. The toner interacts electrostatically with the photoconductor, temporarily bonding to the photoconductor before being transferred to the paper.

In some situations, however, the toner is not applied evenly to the photoconductor, resulting in a density "spike" on the leading edge of the paper. In other words, the toner is applied more heavily at the leading edge of the page than it is on the rest of the page, leading to possible image quality problems, especially at higher page-per-minute output speeds. As disclosed in U.S. patent application Serial No. 60/204,882, incorporated herein by reference, this leading edge density problem may be overcome by increasing the rotational speed of the toning shell beyond the speed at which the toning shell rotates on some currently available printers. Therefore, a need exists in the art for an electrophotographic printer having a toning shell capable of rotating at higher speeds than are attainable with some currently available printers.

Typically, the toning shell is driven by means of a chain driven by a sprocket affixed to a shaft that ultimately is driven through a gear box actuated by the main drive motor of the copier. In certain prior art printers, the toning shell was driven directly by a shaft through a single drive chain, with a sprocket mounted on the shaft and a second sprocket mounted on the toning shell. Given the space constraints of the internal volume of many current printers, it is not feasible to simply affix a larger sprocket to the drive shaft, as such a sprocket large enough to generate the required toning shell speed would not fit within the available space. Similarly, it is not feasible to substitute a smaller drive gear on the toning shell shaft, as such a sprocket would necessarily have a smaller diameter than the shaft on which it would be carried, in order to achieve the necessary speeds.

Accordingly, it is an object of the present invention to provide an electrophotographic printer having a toning shell capable of rotating at higher speeds than currently available printers, without substantially re-designing the interior of the printer. In other words, it is an object of this invention to meet the need for increased toning shell speeds within the design constraints imposed by the physical makeup of some current electrophotographic printers.

Moreover, because toner is incompatible with lubrication oils, the drive chains used in electrophotographic printers are typically oiled lightly during manufacture and are then generally not oiled again during their useful life. As a result, the drive chain exhibits wear over time, typified by a slack in the chain. Therefore, it is preferable to include some form of chain tensioner to maintain appropriate chain tension, despite chain wear. Positioning of the tensioner is, however, difficult, in view of the need for the entire toner assembly to move for purposes of adjustment of the individual components of the toning station relative to each other to accomplish optimal transfer of developer through the toning station. This situation is addressed in U.S. patent application Ser. No. 09/442,303, incorporated herein by reference. When the toner assembly is adjusted, the tensioner must also be adjusted, largely defeating the purpose of the tensioner. Accordingly, there is a need in the art for a chain tensioning assembly that does not require adjustment each time the toning station components are adjusted relative to each other.

Thus it is a further object of this invention to provide an integral toning station bearing and tensioning assembly that provides tension to a drive chain without interfering with the movement of the toning station components that must be moved for necessary adjustments.

SUMMARY OF THE INVENTION

The present invention solves these and other shortcomings of the prior art by utilizing a faster blender shaft speed and reducing it with sprocket tooth and chain combinations, allows for additional multiplication of the speed of the toning shell without resorting to overly large or small drive sprockets. Additionally, the invention includes an intermediate bearing cap having an integral tensioning sprocket to maintain appropriate chain tension despite chain wear. Because the integral tensioner moves with the bearing cap, no separate adjustment of the tensioner is necessary after toning station adjustment.

In one embodiment, the invention is a bearing cap assembly, including a bearing cap housing, containing at least one bearing, and a tension sprocket assembly secured to the bearing cap housing. In a preferred embodiment, the tension sprocket assembly includes a tension sprocket mounted on a shaft, the shaft secured to a backplate, where the backplate is secured in a channel in the bearing cap body, such that the backplate may move along the channel to provide tensioning pressure to a chain passing over the tension sprocket, and where the tension assembly is biased against the drive chain.

In another embodiment, the invention is an electrophotographic printer having a high speed toning shell. The toning station includes a toner blender, a toner bucket and a toning shell, where the toner blender driven by a blender drive shaft and the toner bucket driven by a bucket drive shaft. A first intermediate drive sprocket is affixed to the blender drive shaft such that rotation of the blender drive shaft directly causes rotation of the first intermediate drive sprocket. A second intermediate drive sprocket is affixed to the bucket drive shaft to permit free rotation of the second intermediate drive sprocket relative to the bucket drive shaft, and an intermediate drive chain connects the first and second intermediate drive sprockets, wherein the second intermediate drive sprocket has a larger diameter than the first intermediate drive sprocket. A first primary drive sprocket is affixed to the second intermediate drive sprocket, such that rotation of the second intermediate drive sprocket directly causes rotation of the first primary drive sprocket, and a second primary drive sprocket is affixed to the toning shell. A primary drive chain connects the first and second primary drive sprockets, wherein the first primary drive sprocket has a smaller diameter than the second primary drive sprocket.

In a preferred embodiment, the electrophotographic printer further includes a tension sprocket assembly to maintain tension on the intermediate drive chain. In one embodiment, the tension sprocket assembly includes a tension sprocket that is biased against the intermediate drive chain to exert tensioning pressure on the intermediate drive chain. The tension sprocket is mounted on a shaft having an axis, the shaft secured to a backplate, and the backplate is secured in a channel in the bearing cap body, such that the backplate may move along the channel to provide tension to a chain passing over the tension sprocket. A spring biases the tension assembly against the drive chain.

In another embodiment, the invention is an electrophotographic developing station having a high speed toning shell, including a toner blender, a toner bucket and a toning shell, where the toner blender is driven by a blender drive shaft, and the toner bucket is driven by a bucket drive shaft. A first intermediate drive sprocket is affixed to the blender drive shaft such that rotation of the blender drive shaft directly causes rotation of the first intermediate drive sprocket. A second intermediate drive sprocket is affixed to the bucket drive shaft to permit free rotation of the second intermediate drive sprocket relative to the bucket drive shaft, and an intermediate drive chain connects the first and second intermediate drive sprockets, wherein the second intermediate drive sprocket has a larger diameter than the first intermediate drive sprocket. A first primary drive sprocket is affixed to the second intermediate drive sprocket, such that rotation of the second intermediate drive sprocket directly causes rotation of the first primary drive sprocket. A second primary drive sprocket affixed to the toning shell, and a primary drive chain connects the first and second primary drive sprockets. The first primary drive sprocket has a smaller diameter than the second primary drive sprocket.

DETAILED DESCRIPTION OF THE DRAWINGS AND PREFERRED EMBODIMENTS

Figure 1A:
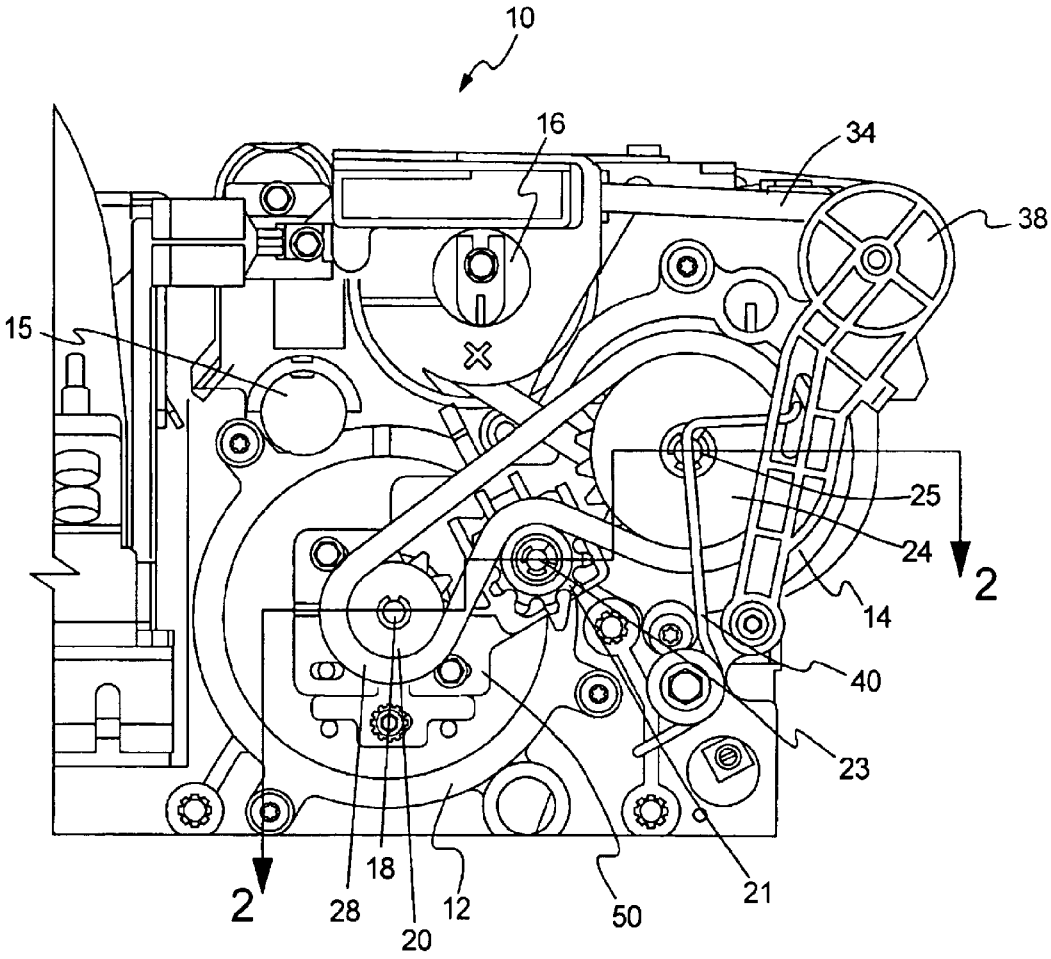
FIG. 1A is a side view of a toning station of the present invention.
Figure 1B:
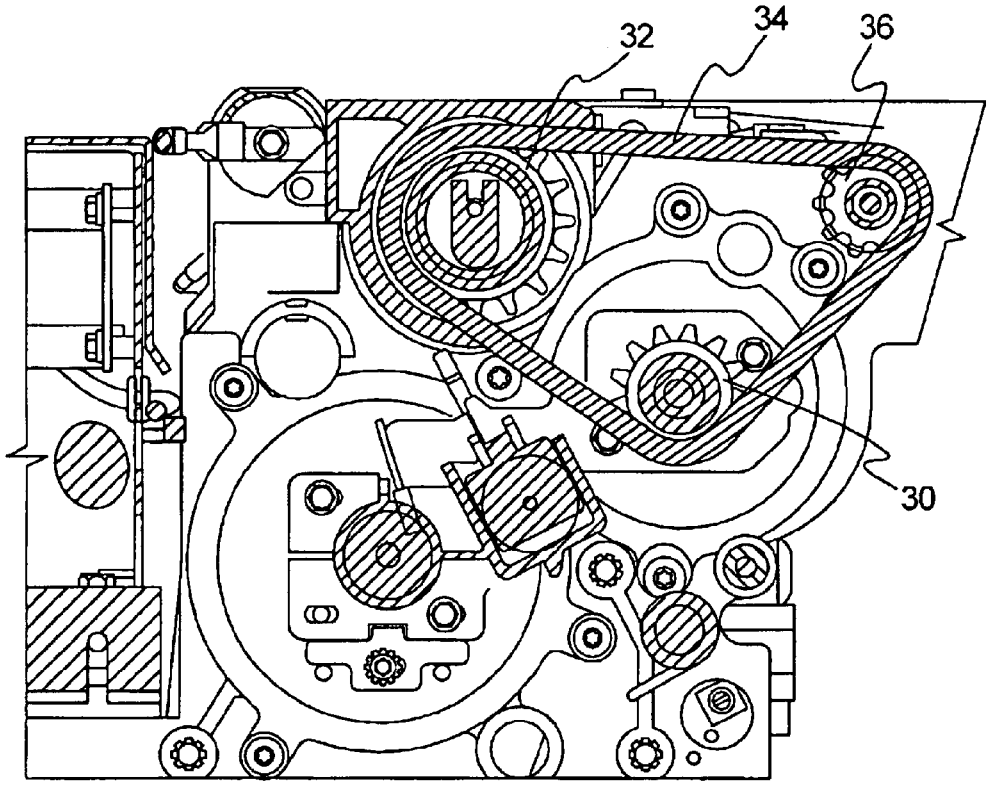
FIG. 1B is a partial cross-sectional view of the toning station, with the intermediate drive chain and sprockets removed to show the primary drive chain and sprockets.
Figure 2:
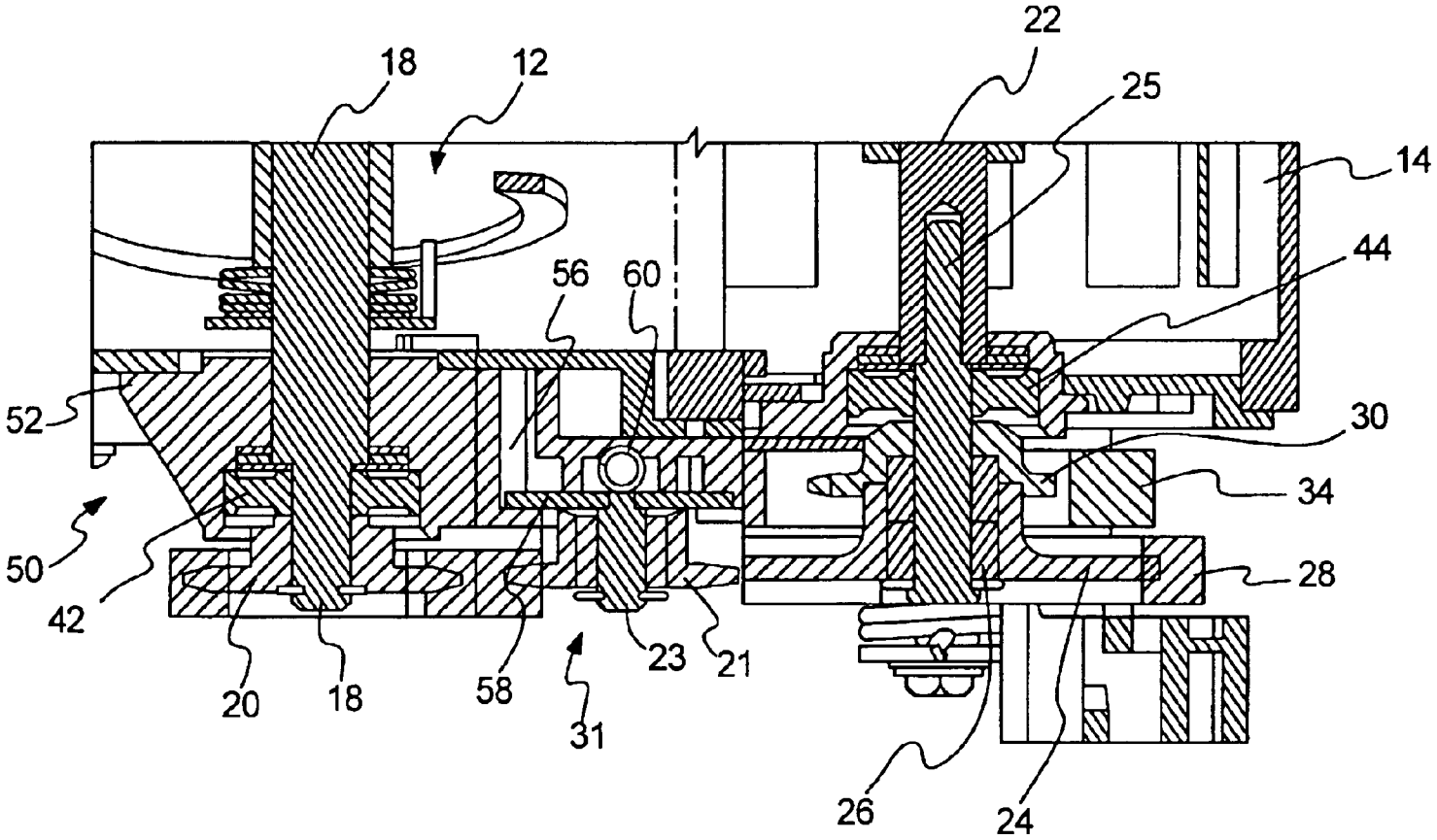
FIG. 2 is cross-sectional view of the toning station taken along line 2—2.

Referring to FIGS. 1A, 1B and 2, a typical toning station 10 of the type employing the present invention includes a developer blender 12 and a developer delivery bucket 14. Toner is delivered to the blender 12 through a toner replenisher (not shown), and is mixed in the blender 12 with a particulate carrier to yield a two-component developer. The blended developer spills over into the bucket 14, and the bucket rotates to deliver developer to the toning shell 16. A toner monitor (not shown) measures the amount of toner in the developer mix and, in the event the proportion of toner falls below a minimum amount, a toner replenisher (not shown) is actuated to deliver additional toner to the blender 12 through toner supply site 15. The toner monitor must be positioned within a narrow tolerance between the blender 12 and the delivery bucket 14 and, therefore, it is necessary to occasionally shift the blender 12 and developer delivery bucket 14 to re-establish the appropriate position relative to the toner monitor.

The blender 12 is driven by a blender shaft 18 that passes through the blender 12 axially, and is ultimately driven through a gear box connected to the main drive motor of the printer (not shown). Affixed to an end of the blender shaft 18 is a first intermediate drive sprocket 20. Likewise, the bucket 14 is driven by an axial bucket shaft 22. A second intermediate drive sprocket 24 rotates on a needle bearing 26 relative to an auxiliary bucket shaft 25, which is press fit into an end of the bucket shaft 22. The needle bearing 26 is seated in a recess in the sprockets 24, 30, and rides on the auxiliary bucket shaft 25. Thus, the second intermediate drive sprocket 24 is not driven by the bucket shaft 22, but rather merely idles on the auxiliary bucket shaft 25 and is driven by an intermediate drive chain 28 that passes around and over the first and second intermediate drive sprockets 20, 24. Accordingly, the rotation of the first intermediate drive sprocket 20, imparted by the blender shaft 18,is transmitted to the second intermediate drive sprocket 24 by the intermediate drive chain 28. As shown in FIG. 1A, the second intermediate drive sprocket 24 is significantly larger in diameter than the first intermediate drive sprocket 20. In a preferred embodiment, the sprocket ratio for the intermediate drive sprockets is 6:11, although other ratios are appropriate and included within the scope of this invention.

The intermediate drive chain 28 is tensioned by an intermediate tension sprocket assembly 31, that includes an intermediate tension sprocket 21, supported on an intermediate tension sprocket shaft 23. As discussed in more detail below, the intermediate tension sprocket 21 is biased laterally with respect to the intermediate drive chain 28 to absorb any slack that develops as the chain 28 wears, maintaining appropriate tension on the chain 28.

A primary drive sprocket 30 is affixed to the second intermediate drive sprocket 24, and, therefore, the second intermediate drive sprocket 24 directly drives the primary drive sprocket 30. The primary drive sprocket 30 drives a toning shell drive sprocket 32 by means of a primary drive chain 34. The primary drive sprocket 30 is smaller in diameter than the toning shell sprocket 32. In a preferred embodiment, the sprocket ratio of the primary drive sprocket 30 and the toning shell sprocket 32 is 2:3, although other ratios appropriate and included in the scope of this invention. The primary drive chain 34 is tensioned by a primary tension sprocket 36 affixed to a tension arm assembly 38, which is biased by an idler tension spring 40.

Figure 3:
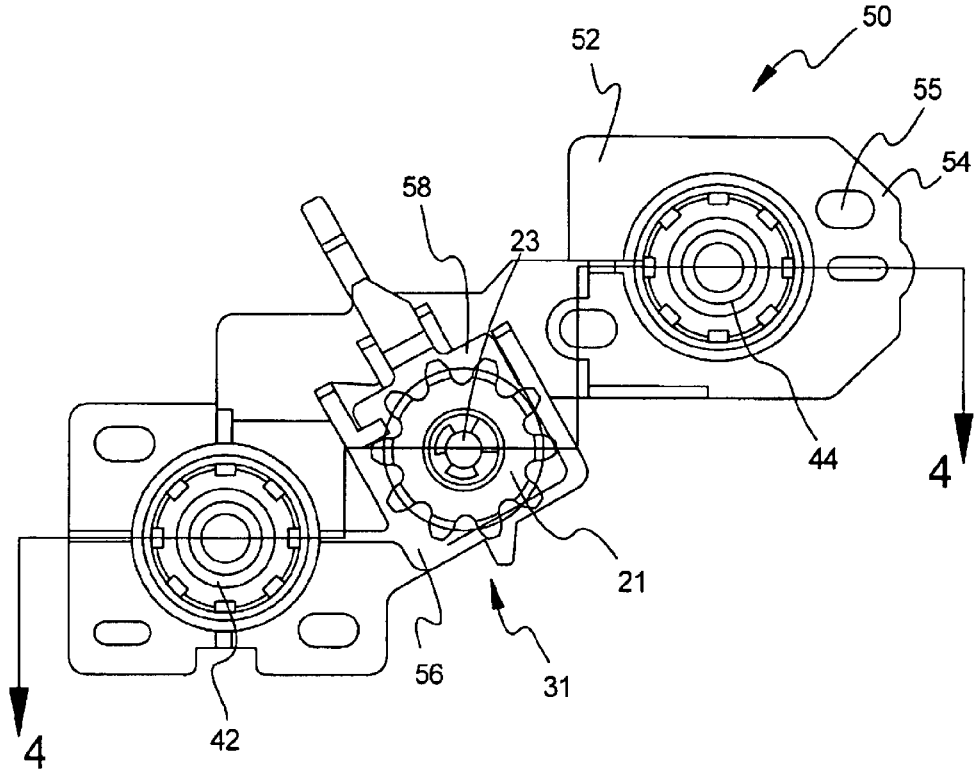
FIG. 3 is a side view of a unitary bearing cap and integral tension sprocket assembly.
Figure 4:
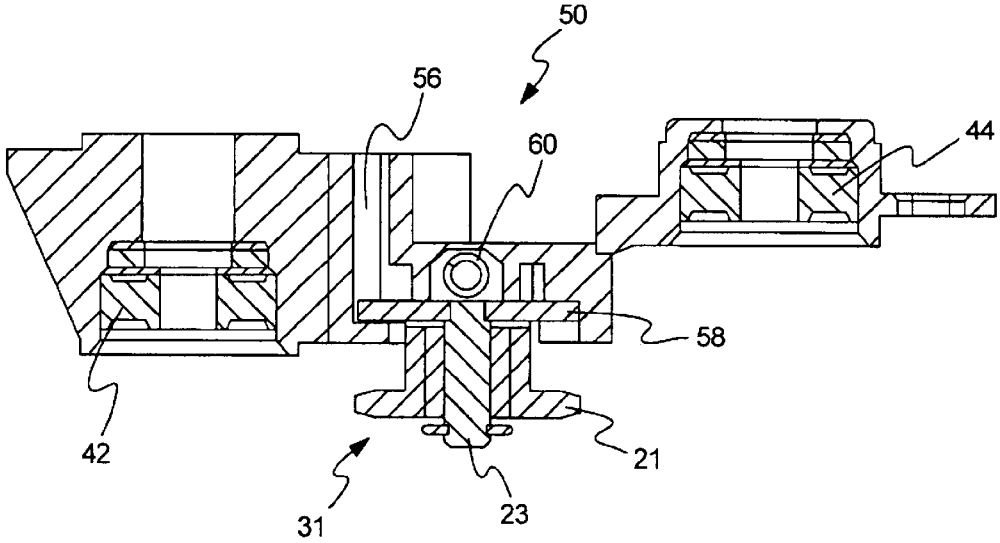
FIG. 4 is a cross-sectional view taken along line 4—4.

Thus, referring also to FIG. 3, the toning shell 16 is driven by toning shell drive sprocket 32, which is driven by the primary drive sprocket 30 through primary drive chain 34. The primary drive sprocket 30 is driven by the second intermediate drive sprocket 24, which is driven by the first intermediate drive sprocket 20, through intermediate drive chain 28. The first intermediate drive sprocket 20 is driven directly by the blender shaft 18.

In a preferred embodiment, the locations of the drive sprockets 20, 24, 30 and the intermediate tension assembly 31 are maintained by a unitary bearing cap and tensioner assembly 50. The bearing cap assembly 50 includes bearing cap body 52, a blender bearing 42 and a bucket bearing 44, that carry, respectively, the blender shaft 18 and the auxiliary bucket shaft 25. The bearing cap body 52 includes mounting brackets 54 defining apertures 55 to accept bolts or similar fasteners that affix the bearing cap 50 to the face of the blender 12 and the bucket 14.

The bearing cap body 52 defines a channel 56 that receives and retains an intermediate tensioner backplate 58.

The intermediate tensioner shaft 23 is affixed to the backplate 58. The backplate 58 is slidably retained in channel 56, such that the backplate 58 and, thus, the intermediate tension shaft 23 and intermediate tension sprocket 21 are able to slide along the length of the channel, thus moving the intermediate tension sprocket 21 across the face of the bearing cap 50.

The backplate 58 is biased against the intermediate drive chain 28, such that when the intermediate drive chain 28 passes under the first and second intermediate drive sprockets 20, 24 and over the intermediate tension sprocket 21, the intermediate drive chain 28 is tightened, while ensuring that the intermediate drive chain 28 remains in contact with the intermediate drive sprockets 20, 24. In a preferred embodiment, the backplate 58 is biased against the drive chain by a spring 60, although other arrangements will be apparent to those skilled in the art.

It is to be understood that the foregoing detailed description describes presently preferred embodiments of the invention and that other alternatives, which will become apparent to those of skill in the art upon reviewing the foregoing description, are likewise intended to fall within the scope of the appended claims, including equivalents thereto.

We claim:

1. An electrophotographic development station comprising a bearing cap body, sprockets attached to the bearing cap body, a tension sprocket assembly secured to the bearing cap body, and a drive chain around the sprockets and the tension sprocket assembly, wherein the drive chain, tension sprocket assembly, the sprockets and the bearing cap body are moveable as a unit without changing a tension in the drive chain.

2. The electrophotographic development station of claim 1, wherein the development station comprises a blender and a bucket, and wherein one of the sprockets is mounted on a shaft attached to the blender, and another of the sprockets is mounted on another shaft attached to the bucket.

3. The electrophotographic development station of claim 2, wherein the tension sprocket assembly is located in between the shaft and the another shaft.

4. The electrophotographic development station of claim 1, wherein the tension sprocket assembly comprises:

a tension sprocket mounted on a shaft, the shaft secured to a backplate;

the backplate slidably secured in a channel in the bearing cap body such that the backplate may slide within the channel and is biased to provide tensioning pressure to the drive chain.

5. The electrophotographic development station of claim 1, wherein the bearing cap body encloses first and second bearings and the tension sprocket assembly is located in between the first and second bearings.

6. The electrophotographic development station of claim 1, wherein the bearing cap body encloses first and second bearings and the sprockets are mounted on first and second shafts positioned in the first and second bearings.

7. The electrophotographic development station of claim 1, wherein the tension sprocket assembly is biased by a spring.

8. An electrophotographic printer, comprising:

an electrophotographic development station comprising a bearing cap body, sprockets attached to the bearing cap body, a tension sprocket assembly secured to the bearing cap body, and a drive chain around the sprockets and the tension sprocket assembly, wherein the drive chain, the tension sprocket assembly, the sprockets and the bearing cap body are moveable as a unit without changing a tension in the drive chain.

9. The electrophotographic printer of claim 8, wherein the development station comprises a blender and a bucket, and wherein one of the sprockets is mounted on a shaft attached to the blender, and another of the sprockets is mounted on another shaft attached to the bucket.

10. The electrophotographic printer of claim 8, wherein the tension sprocket assembly comprises a tension sprocket mounted on a shaft.

11. The electrophotographic printer of claim 8, wherein the tension sprocket assembly is biased by a spring.

12. The electrophotographic printer of claim 8, wherein the bearing cap body encloses first and second bearings and the tension sprocket assembly is located in between the first and second bearings.

13. The electrophotographic printer of claim 8, wherein the bearing cap body encloses first and second bearings and the sprockets are mounted on first and second shafts positioned in between the first and second bearings.

14. The electrophotographic printer of claim 8, wherein the tension sprocket assembly comprises:

a tension sprocket mounted on a shaft, the shaft secured to a backplate;

the backplate slidably secured in a channel in the bearing cap body such that the backplate may slide within the channel and is biased to provide tensioning pressure to the drive chain.

15. An electrophotographic development station method of operation comprising tensioning a drive chain disposed around sprockets attached to a bearing cap body with a tension sprocket assembly secured to the bearing cap body, wherein the drive chain, the tension sprocket assembly, the sprockets and the bearing cap body are moveable as a unit without changing a tension in the drive chain.

16. The method of claim 15, wherein the development station comprises a blender and a bucket, and wherein one of the sprockets is mounted on a shaft attached to the blender, and another of the sprockets is mounted on another shaft attached to the bucket.

17. The method of claim 16, wherein the tension sprocket assembly is located in between the shaft and the another shaft.

18. The method of claim 15, wherein the tension sprocket assembly comprises:

a tension sprocket mounted on a shaft, the shaft secured to a backplate;

the backplate slidably secured in a channel in the bearing cap body such that the backplate may slide within the channel and is biased to provide tensioning pressure to the drive chain.

19. The method of claim 15, wherein the bearing cap body encloses first and second bearings and the tension sprocket assembly is located in between the first and second bearings.

20. The method of claim 15, wherein the bearing cap body encloses first and second bearings and the sprockets are mounted on first and second shafts positioned in between the first and second bearings.

21. The method of claim 15, wherein the tension sprocket assembly is biased by a spring.

* * * * *